US005150688A

United States Patent [19]

Nothdurft et al.

[11] Patent Number: 5,150,688

[45] Date of Patent: Sep. 29, 1992

[54] MAGNET VALVE, IN PARTICULAR FOR FUEL INJECTION PUMPS

[75] Inventors: Heinz Nothdurft, Stuttgart; Reinhard Trunk, Schwieberdingen; Kurt Sprenger, Illingen-Schützing; Carlos Alvarez-Avila, Freiberg/Neckar, all of Fed. Rep. of Germany

[73] Assignee: Robert Bosch GmbH, Stuttgart, Fed. Rep. of Germany

[21] Appl. No.: 687,926

[22] PCT Filed: Sep. 28, 1990

[86] PCT No.: PCT/DE90/00740

§ 371 Date: Jun. 7, 1991

§ 102(e) Date: Jun. 7, 1991

[87] PCT Pub. No.: WO91/05950

PCT Pub. Date: May 2, 1991

[30] Foreign Application Priority Data

Oct. 20, 1989 [DE] Fed. Rep. of Germany ..... 3934953

[51] Int. Cl.[5] ..... F02M 37/04

[52] U.S. Cl. ..... 123/506; 123/449

[58] Field of Search ..... 123/449, 506, 458, 503; 251/118, 129.1-129.8

[56] References Cited

U.S. PATENT DOCUMENTS

| | | | |
|---|---|---|---|
| 4,412,519 | 11/1983 | Hoch | 123/449 |
| 4,491,111 | 1/1985 | Eheim | 123/449 |
| 4,563,133 | 1/1986 | Yasuhara | 123/458 |
| 4,617,959 | 10/1986 | Yamada | 137/512.1 |
| 4,723,570 | 2/1988 | Baba | 137/454.5 |
| 4,753,212 | 6/1988 | Miyaki | 123/506 |
| 4,793,314 | 12/1988 | Yoshinaga | 123/506 |
| 4,832,311 | 5/1989 | Kiwura | 251/118 |
| 4,840,155 | 6/1989 | Karle | 123/506 |
| 4,974,564 | 12/1990 | Laufer | 123/449 |
| 5,007,400 | 4/1991 | Babitzka | 123/449 |

FOREIGN PATENT DOCUMENTS

| | | | |
|---|---|---|---|
| 3142750 | 8/1982 | Fed. Rep. of Germany | 123/449 |
| 3219612 | 1/1983 | Fed. Rep. of Germany | 123/449 |
| 0211757 | 11/1984 | Japan | 123/449 |
| 0223351 | 9/1988 | Japan | 123/449 |

*Primary Examiner*—Carl S. Miller

*Attorney, Agent, or Firm*—Edwin E. Greigg; Ronald E. Greigg

[57] ABSTRACT

A magnet valve that serves to block off a fuel intake line to control fuel flow to supply a pump work chamber of a fuel injection pump with fuel, a closing element has a bore entering at the face end, which bore can be closed by a valve member under the influence of a closing spring. When pressure surges occur in one part of the intake line which is closed by the closing element and leading to the pump work chamber, instead of the closing element and the entire cross section of the intake line portion being opened, only the cross section of the bore is opened. Once it has been pushed open, this bore is rapidly closed again by the low-mass valve member, so that only small quantities of fuel can flow via the bore for pressure equalization.

8 Claims, 2 Drawing Sheets

MAGNET VALVE, IN PARTICULAR FOR FUEL INJECTION PUMPS

BACKGROUND OF THE INVENTION

The invention is based on a magnet valve as defined hereinafter. In such a magnet valve, known from German Patent 25 03 345, the closing element is coupled to the armature of the magnet valve via a drag coupling, and the armature is embodied with its face end that plunges into the closing part as a valve element, so that this element blocks the communication between the intake line parts via the bore whenever the armature, under the influence of the restoring spring, moves or has moved the closing part into the closing position. Upon opening of the magnet valve the armature is lifted from its seat on the closing part under the influence of the magnetic force of the electromagnet, opens the bore, and only in the course of a further stroke lifts the closing part from its seat via the drag coupling, so that the force for opening the closing part, which is acted upon by both the restoring spring and the pressure prevailing upstream of the seat in the intake line, can be kept small, because a pressure equalization is effected previously via the bore.

Under certain conditions, however, it may happen with a magnet valve of this generic type that the closing part, when it is moved to the closing position, is acted upon by a pressure pulse from the pump work chamber in the course of the remaining delivery stroke of the fuel injection pump and after opening of the communication between the intake line and the pump work chamber. This pressure pulse can cause the closing part to be lifted from its seat, so that a process of refilling the pump work chamber can briefly take place via the intake line. This quantity flowing through the pump work chamber can also be brought to injection in the next delivery stroke of the pump piston, and thus the purpose of the magnet valve, which is to serve for the purpose of shutoff, is not attained. In particular, with such a defect in the control of the fuel injection pump, the internal combustion engine can race.

ADVANTAGES OF THE INVENTION

A magnet valve according to the invention has the advantage over the prior art that pushing open of the closing part and thus a correspondingly large flow of fuel to the pump work chamber is prevented, since the pressure pulse is reduced via the open valve member, which opens only a small overflow cross section.

By the provisions recited in the specification further advantageous developments of and improvements will become apparent. A small valve member with flow mass is the result which can reach its closing position again with low inertia, so that there is only a minimal reverse flow effect after the valve member has been pushed open. The disadvantages referred to at the outset are thus avoided to the greatest possible extent.

DRAWINGS

One exemplary embodiment of the invention is shown in the drawing, and will be described in further detail in the ensuing description.

DESCRIPTION OF THE EXEMPLARY EMBODIMENT

Figure 1:
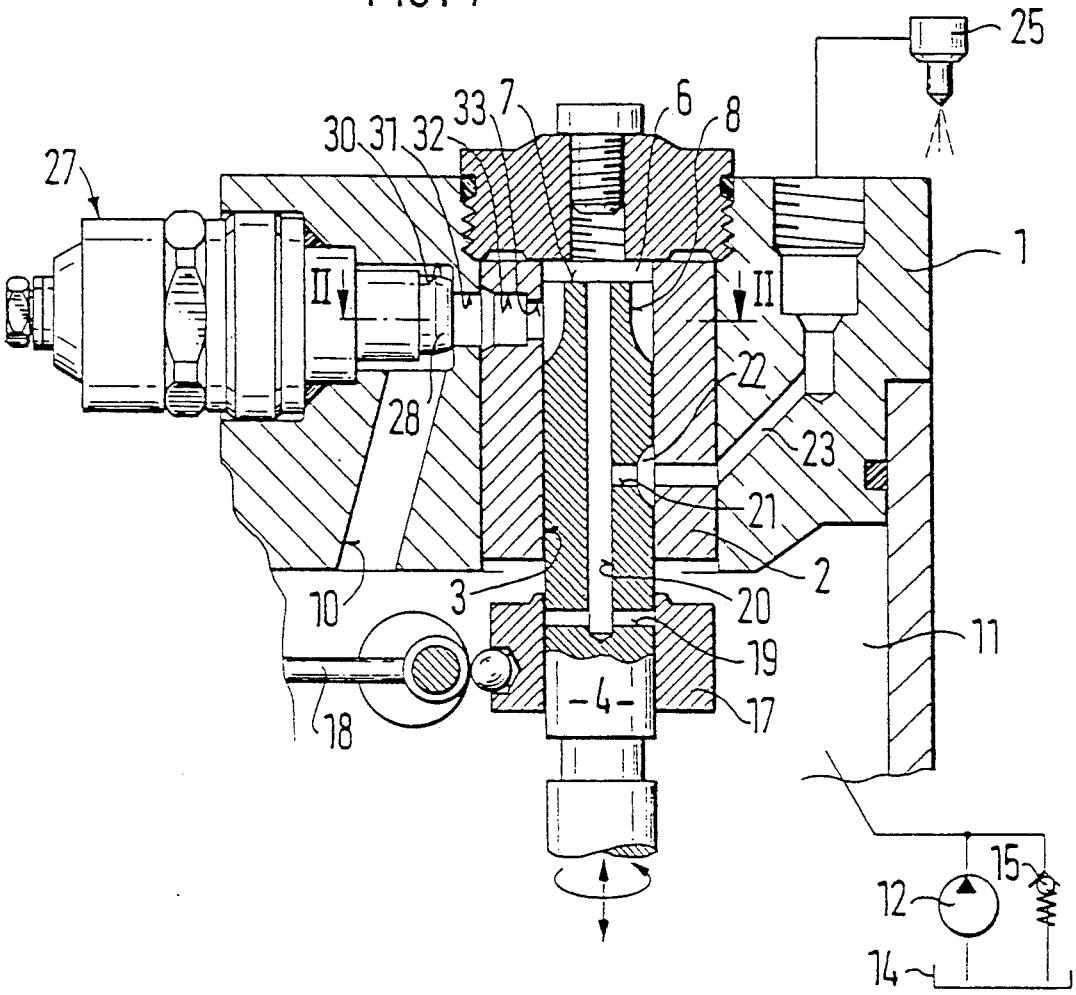
FIG. 1 is a fragmentary longitudinal section through a fuel injection pump, in which magnet valve according to the invention is used.
Figure 2:
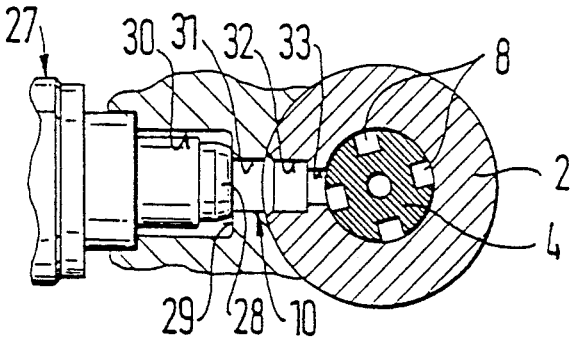
FIG. 2 is a fragmentary section through FIG. 1 along the line II—II.

In the fuel injection pump shown in FIG. 1 for multicylinder internal combustion engines, a cylinder liner 2 is inserted into a housing 1, and in its cylinder bore 3, a pump piston 4 is set into simultaneously reciprocating and rotating motion, as indicated by the arrows in the drawing, by a drive mechanism and cam drive, not further shown, of the fuel injection pump. In the cylinder bore 3, the pump piston 4 on its face end encloses a pump work chamber 6, which is supplied with fuel in the intake stroke of the pump piston via longitudinal grooves 8, which serve as filling grooves, originating at the face end 7 of the pump piston. As can be seen from FIG. 2, which is a section through FIG. 1 along the line II—II, the filling grooves 8 are distributed at uniform angular intervals around the jacket face of the pump piston. In FIG. 2, four of these grooves are shown, corresponding to four intake strokes effected per pump piston revolution, for supplying in this case four injection nozzles in alternation through this distributor fuel injection pump. During the intake stroke, one of the filling grooves 8 at a time is made to communicate with an intake line 10 discharging laterally into the cylinder bore 3, this line communicating with a pump suction chamber 11, which is enclosed in the housing of the fuel injection pump. The pump suction chamber 11 is supplied with fuel, which is preferably at rpm-dependent pressure, by a fuel feed pump 12 from a fuel supply tank 14, under the additional control of a pressure control valve 15 that is located parallel to the fuel feed pump 12, which is driven synchronously with the fuel injection pump in terms of rpm.

The end of the pump piston opposite the pump work chamber 6 protrudes into the aforementioned pump suction chamber 11, where it is connected to the drive mechanism, not shown. Inside the suction chamber, an annular slide 17 is displaceably disposed on the jacket face of the pump piston; this slide is displaceable in a known manner via a governor of a known type, not shown here, via a governor lever 18 and in this process controls the outlet opening of a transverse bore 19 in the pump piston. The transverse bore 19 communicates with the longitudinal conduit 20 in the pump piston, which enters axially at the face end 7 of the pump piston and ends as a blind bore. Also branching off from this longitudinal conduit is a radial bore 21, which leads to a distributor opening, in this case a distributor groove 22, on the jacket face of the pump piston. Injection lines 23, which for example each lead via a pressure valve to one injection valve 25, branch off from the cylinder bore 3 at the level of this distributor groove. Such injection lines are distributed about the circumference of the cylinder bore 3 in a number corresponding to that of the injection valves to be supplied, in this case four, as a result of the fact that the pump piston executes four delivery strokes per revolution.

During the various intake strokes of the pump piston, the piston aspirates fuel from the pump suction chamber 11 via the filling groove 8, which then has been made to coincide with the intake line, so that the pump work chamber 6 is filled with fuel when the ensuing delivery stroke begins. In the load position, the annular slide 17 has then closed the outlets of the transverse bore 19, so that in the ensuing delivery stroke of the pump piston and after reclosure of the filling groove in the pump work chamber, the fuel is brought to high pressure, and then via the longitudinal conduit 20 and one of the injection lines 23 is supplied to the corresponding fuel injection valve and is injected. To end the high-pressure injection, the transverse bore emerges from coincidence at a stroke predetermined by the annular slide 17, so that the pump work chamber is now relieved toward the pump suction chamber, via the longitudinal bore 20 and the transverse bore 19, the feed pressure of the pump piston drops below the opening pressure of the injection valve, and the high-pressure injection is thus interrupted.

For turning off the engine or to terminate the high-pressure injection, a magnet valve 27 is also provided in the intake line 10, and its closing element 28 cooperates with a valve seat 29 embodied as a flat seat, on which the closing element 28 comes to rest by the force of a restoring spring when the magnet of the magnet valve is without current. The valve seat is located at the transition between a stepped bore portion 31 of small diameter, toward the pump chamber, and the stepped bore portion 30 of large diameter of a stepped bore, which receives the magnet valve inserted from the outside. From the stepped bore portion 30 of large diameter, the intake line 10 leads on to the pump suction chamber 11. The stepped bore portion 31 of small diameter discharges into a recess 32 in the cylinder liner 2, and from there an intake line segment 33 of rectangular cross section discharges into the cylinder bore 3.

Figure 3:
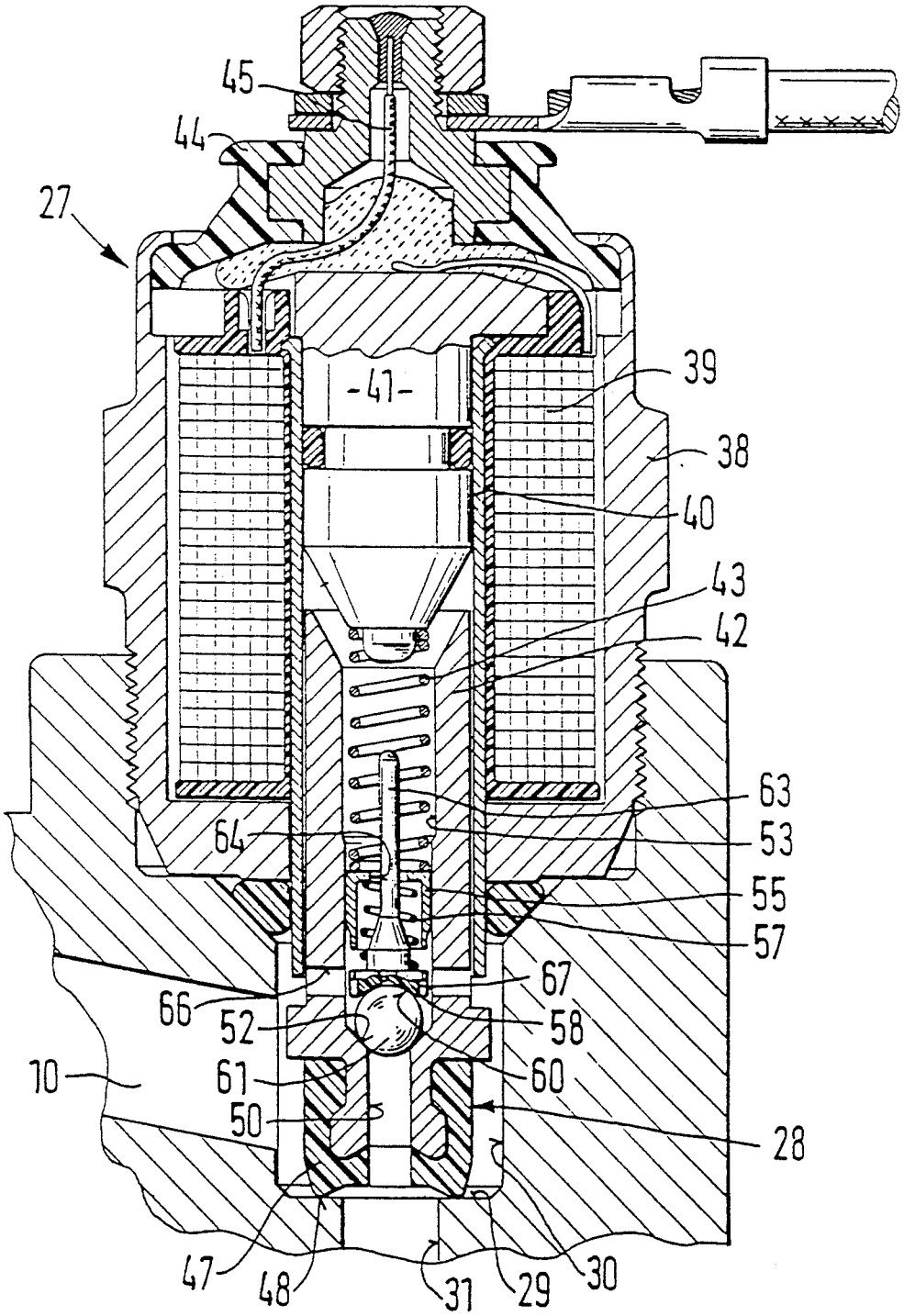
FIG. 3 is a longitudinal section through the magnet valve according to the invention, on a larger scale.

The magnet valve 27 is shown in detail in FIG. 3. A magnet coil 39 and a guide sleeve 40 surrounded by it, into which a magnet core 41 plunges, are disposed in the housing 38 of the magnet valve. An armature 42, which is loaded by the restoring spring 43, is displaceable in the guide sleeve 40. On the side of the magnet valve remote from the armature, the valve housing 38 is closed by a plastic part 44, through which the current supply line 45 leads to the magnet coil 39. The space existing between the valve housing 38 and the magnet coil 39 is filled with a synthetic resin, to prevent valve parts from jarring loose because of shocks transmitted from the engine. The core 41 and the armature 42 are conically embodied on the face ends oriented toward one another, in order to obtain a favorable magnetic force transmission when the strokes necessary for the use of the magnet valve are long. The armature simultaneously acts as a valve element, in that its end protruding from the guide sleeve 40 into the stepped bore portion 30 of larger diameter is embodied as a closing element 28. To this end, a hat-shaped cap 47 of elastic sealing material is vulcanized onto this end of the armature 42 and comes to rest on the face end of the valve seat 29 with its encompassing outer edge 48 whenever the armature and closing element 28 are brought into the closing position by the force of the restoring spring 43 when the magnet coil is without current.

The armature 42 has a bore 50 passing through the face end of the cap 47 coaxially with the stepped bore portion 31; and the bore 50 discharges into the receiving bore 53 of larger diameter via a conical valve seat 52, which may instead be spherical. This receiving bore is continued with substantially the same diameter as far as its outlet at the conically shaped face end of the armature opposite the core 41. The restoring spring 43 is disposed in this receiving bore and is supported on the face end on the correspondingly conically embodied core, on a shoulder portion, and at the other end is supported on a sleeve which is pressed into the receiving bore 53. This sleeve, which may instead be fixed in the receiving bore in some other way, can be called an intermediate spring plate 55, because a closing spring 57 is supported on it on the other end. This spring 57, which is embodied as a compression spring, comes to rest with its other end on a spring plate 58, which is displaceable inside the receiving bore 53. On its face end toward the bore 50, the spring plate has a recess 60, in which a ball 61 that serves as a valve element is centered. On the other hand, in the closing position, the ball 61 comes to rest on the conical valve seat 52 which is provided between the receiving bore 53 and the bore 50. Advantageously, the spring plate 58 is of plastic and has a stem 63 on the side with the closing spring 57; the stem protrudes through a middle opening 64 in the intermediate spring plate 55 and is guided therein. On its circumference, the intermediate spring plate 55 has recesses 67, so that upon an adjustment of the intermediate spring plate or of the armature, fuel can flow unthrottled past the intermediate spring plate, and its motion is unhindered. Branching off from the receiving bore 53 are transverse openings 66, by way of which the parts of the intake line 10 upstream and downstream of the valve seat 29 are in communication, when the valve member 61 is lifted, even if the closing element 28 is in the closing position, and upon opening of the closing element 28 by the armature 42, the fuel positively displaced by the armature can flow out by way of this contruetion.

The low mass of the ball 61 and spring plate 58 with a correspondingly dimensioned closing spring enables a very fast opening and reclosure of the bore 50 or of the communication between the intake line parts with low hysteresis. In this way the flow of relatively large quantities of fuel from the pump work chamber for pressure equalization is prevented, even if the valve member had been moved into the opening position by pressure surges. The lifting from its seat of the valve element 28 that controls the essentially greater diameter of the stepped bore portion 31 is prevented in each case.

The danger of engine racing is thus reduced. The danger of engine racing exists particularly whenever the annular slide 17 has been displaced to a very high position toward the pump work chamber and has for instance becomes jammed, so that the entire or nearly entire quantity of fuel that can be fed by the pump piston leaves the work chamber and is injected, since only a very small residual stroke or none at all, with relief toward the pump suction chamber, now takes place. The danger also exists whenever, because of the injection timing adjustments, the delivery stroke of the pump piston is late with respect to its rotational position, so that the filling grooves 8 already furnish the communication between the pump work chamber and the intake line 10 or 31, 32, 33 at top dead center of the pump piston or earlier. As a result, fuel at high pressure suddenly enters the recess 32 and the adjoining stepped bore portion of smaller diameter 31, and this fuel acts in a pulselike fashion on the closing element 28 and attempts to lift it. Because of the storage capacity of the elastic fuel medium, a relatively larger quantity of fuel can therefore be stored in the space between the cylinder bore 3 of the valve seat 29, especially if negative pressures are again compensated for via the intake line 10 with the closing element 28 opened. This stored quantity flows to the pump work chamber in the ensuing intake stroke, and the pressure of the fuel in the recess 32 and adjoining areas 31, 33 and in the pump work chamber is lowered accordingly. After the closure of the portion 33 of the intake line by the filling groove, a volume of relatively low pressure remains in the region up to the valve seat, and a majority of the fuel previously stored there at high pressure has reached the pump work chamber. From it, the fuel can again be injected upon the ensuing compression stroke, particularly if the pump work chamber cannot be relieved via the annular slide. At the end of the delivery stroke, upon reopening of the portion 33 of the intake line, or of the following spaces, the pressure search can again push open the closing element 28, which is followed by a pressure equilibrium and a renewed inflow of fuel to the pump work chamber as described before. With the embodiment according to the invention, these processes are now maximally avoided. As a result, reliable shutoff of fuel injection is attained.

The foregoing relates to a preferred exemplary embodiment of the invention, it being understood that other variants and embodiments thereof are possible within the spirit and scope of the invention, the latter being defined by the appended claims.

We claim:

1. A magnet valve for controlling a fuel supply to injection pumps for supplying fuel to internal combustion engines, which comprises an intake line (10) that connects a pump work chamber (6) of the fuel injection pump to a fuel supply source (11), said magnet valve is positioned relative to said intake line (10) to block fuel flow to control an end of the fuel injection and to permit fuel through said intake line (10) said pump work chamber during an intake stroke of a pump piston (4); said magnet valve includes a closing element (28) connected to an armature (42) of said magnet valve, said closing element and said armature are retained by a restoring spring (43) in a closed position of said closing element on a valve seat (29) formed in said intake line (10) from which the intake line (10, 31, 32, 33) leads to said pump work chamber (6), and said closing element is acted upon in the closing position by a pressure prevailing in the intake line toward the valve seat, said closing element includes a bore (50) which connects a portion of said intake line (10) to parts of the intake line toward said pump work chamber which bore is closable by a valve member (61) acted upon by a closing spring (57) counter to the pressure in the portion of the intake line toward the pump work chamber, said closing spring (57) is supported in the armature (42) and said restoring spring (43) is supported in a stationary manner at one end.

2. A magnet valve as defined by claim 1, in which the bore (50) in the closing element (28) is an axial bore, which discharges into a receiving bore (53) via a conical or spherical valve seat (52) and the valve member (61) and the closing spring (57) are disposed in said bore (53).

3. A magnet valve as defined by claim 2, in which the receiving bore (53) passes axially through the closing element (28) and the armature (42) and has a firmly inserted intermediate spring plate (55), which serves as a support point for the restoring spring supported on the stationary core (41) of the magnet of the magnet valve, and serves as a support point for the closing spring (57).

4. A magnet valve as defined by claim 3, in which the valve member (61) is a ball, which is supported on a recess (60) in a spring plate (58) and which includes a tang (63) that is guided by a middle opening (64) of the intermediate spring plate (55).

5. A magnet valve as defined by claim 4, in which the spring plate is made of plastic.

6. A magnet valve as defined by claim 3, in which the intermediate spring plate (55) is pressed into the receiving bore (53), which communicates with the intake line (10) via a transverse opening (66).

7. A magnet valve as defined by claim 4, in which the intermediate spring plate (55) is pressed into the receiving bore (53), which communicates with the intake line (10) via a transverse opening (66).

8. A magnet valve as defined by claim 5, in which the intermediate spring plate (55) is pressed into the receiving bore (53), which communicates with the intake line (10) via a transverse opening (66).

* * * * *